US009084487B1

(12) United States Patent
Su

(10) Patent No.: US 9,084,487 B1
(45) Date of Patent: Jul. 21, 2015

(54) CHAIR ARMREST ASSEMBLY

(71) Applicant: Chih-Cheng Su, Dongguan (CN)

(72) Inventor: Chih-Cheng Su, Dongguan (CN)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 0 days.

(21) Appl. No.: 14/479,312

(22) Filed: Sep. 6, 2014

(51) Int. Cl.
*A47C 7/54* (2006.01)
*A47C 1/03* (2006.01)

(52) U.S. Cl.
CPC .... *A47C 1/03* (2013.01); *A47C 7/54* (2013.01)

(58) Field of Classification Search
CPC ..... A47C 7/546; A47C 7/54; A47C 1/03
USPC ..... 297/411.35, 411.36, 411.37
See application file for complete search history.

(56) References Cited

U.S. PATENT DOCUMENTS

| | | | | |
|---|---|---|---|---|
| 5,931,537 | A * | 8/1999 | Gollin et al. | 297/411.36 |
| 6,419,323 | B1 * | 7/2002 | Chu et al. | 297/411.36 |
| 6,974,189 | B2 * | 12/2005 | Machael et al. | 297/411.36 |
| 7,188,907 | B1 * | 3/2007 | Lai | 297/411.35 |
| 2007/0093129 | A1 * | 4/2007 | Ho | 439/579 |
| 2012/0025584 | A1 * | 2/2012 | Chen et al. | 297/411.37 |

FOREIGN PATENT DOCUMENTS

WO WO2014109647 A1 * 7/2014

* cited by examiner

*Primary Examiner* — Milton Nelson, Jr.

(57) ABSTRACT

The armrest assembly includes a connecting seat, an adjusting rod, a link and an armrest seat. The connecting seat has a connecting rod and a hollow connecting tube with a fixing hole. The adjusting rod has a ring and a bar. The bar is received in the connecting tube and formed with adjusting holes in a row. A fixing block is formed under the adjusting holes and inserted into the fixing hole. The link passes through the connecting tube. Two ends of the link are separately formed with a fixing insert for being inserted into one of the adjusting holes and a pushing button. The armrest seat has a support and an armrest. The support is received in the connecting tube and receives the link. The pushing button projects from a through hole of the support.

9 Claims, 13 Drawing Sheets

CHAIR ARMREST ASSEMBLY

BACKGROUND OF THE INVENTION

1. Technical Field

The invention relates to office chairs, particularly to adjustable armrests of office chairs.

2. Related Art

Ergonomic chairs have been very popular in the market. Such a kind of chairs has various adjustment functions to provide comfort support to users.

An armrest of a conventional ergonomic chair can be adjusted, but only two positions can be adjusted to because of its simple structure. Although there are some armrest structures using a rail and fixing mechanism to improve adjustment, their durability is not good enough.

In sum, simple adjustment structures do not possess good durability, but adjustment structures with good durability are too expensive. There is not a moderate product which can satisfy two requirements of durability and cost.

SUMMARY OF THE INVENTION

An object of the invention is to provide a chair armrest assembly, which is simple and durable to adjust an armrest.

To accomplish the above object, the armrest assembly of the invention includes a connecting seat, an adjusting rod, a link and an armrest seat. The connecting seat has a connecting rod and a hollow connecting tube with a fixing hole. The adjusting rod has a ring and a bar. The bar is received in the connecting tube and formed with adjusting holes in a row. A fixing block is formed under the adjusting holes and inserted into the fixing hole. The link passes through the connecting tube. Two ends of the link are separately formed with a fixing insert for being inserted into one of the adjusting holes and a pushing button. The armrest seat has a support and an armrest. The support is received in the connecting tube and receives the link. The pushing button projects from a through hole of the support.

DETAILED DESCRIPTION OF THE INVENTION

Figure 1:
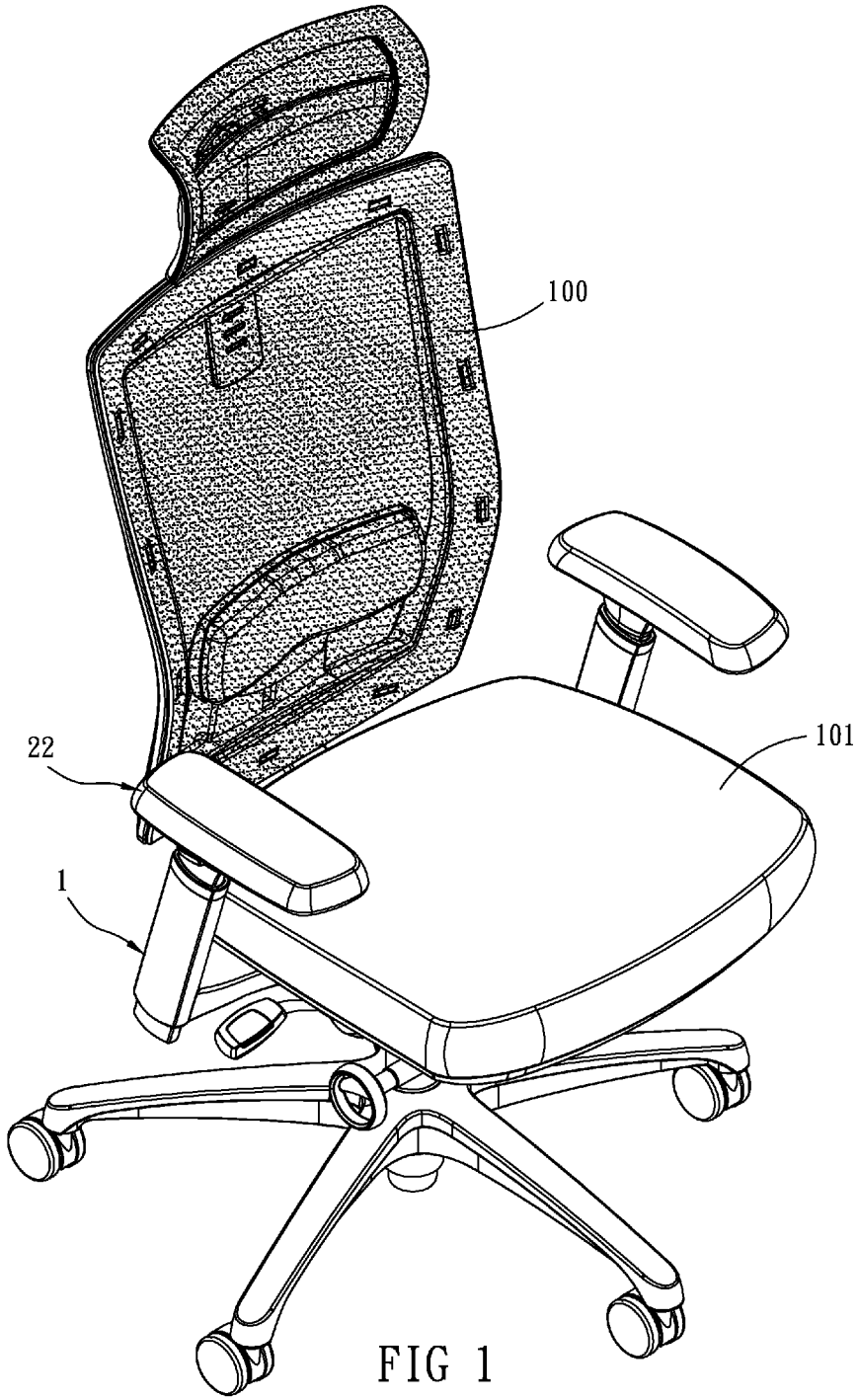
FIG. 1 is a schematic view of the invention installed in a chair.
Figure 2:
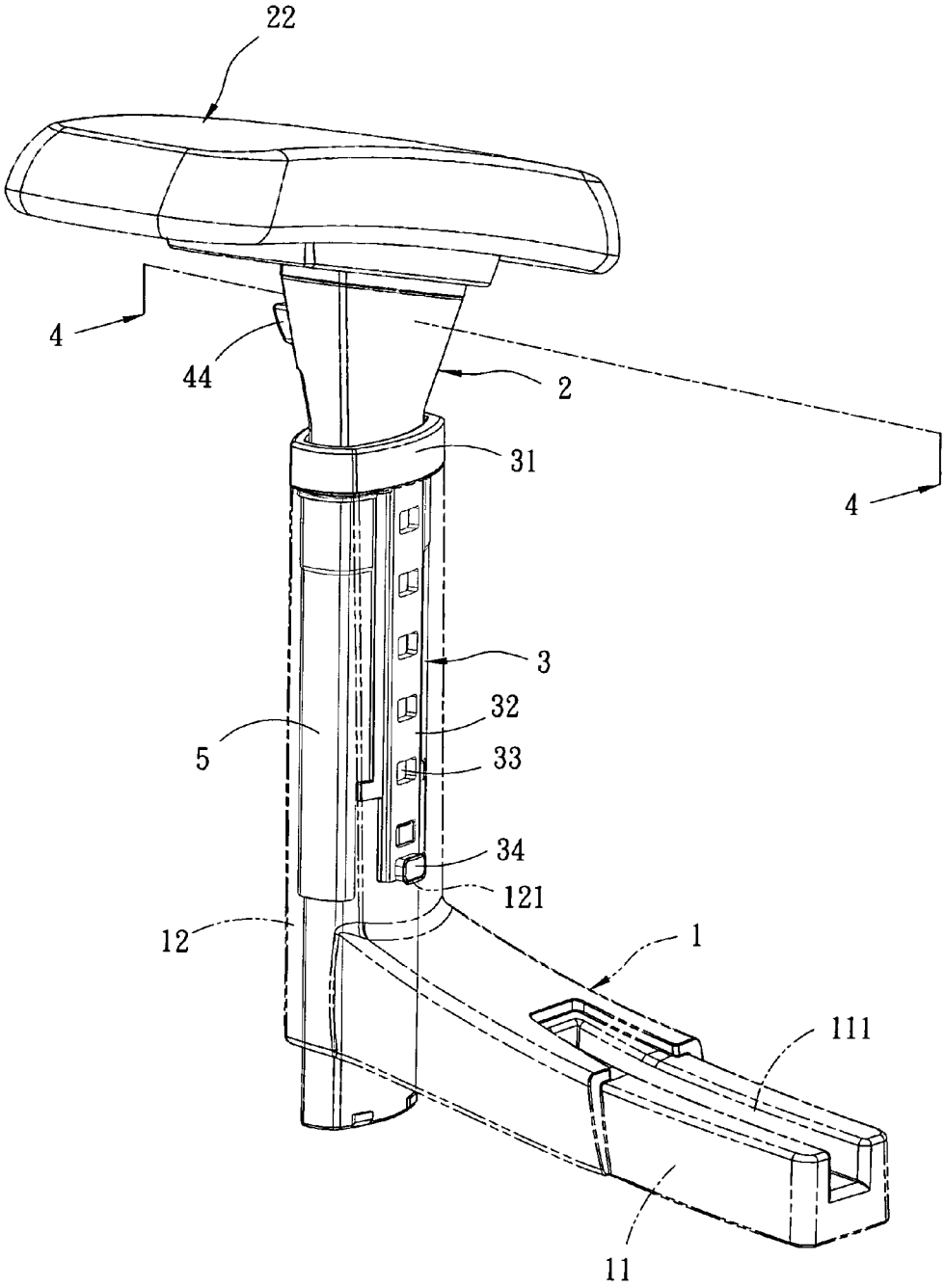
FIG. 2 is an assembled view of the invention.
Figure 3:
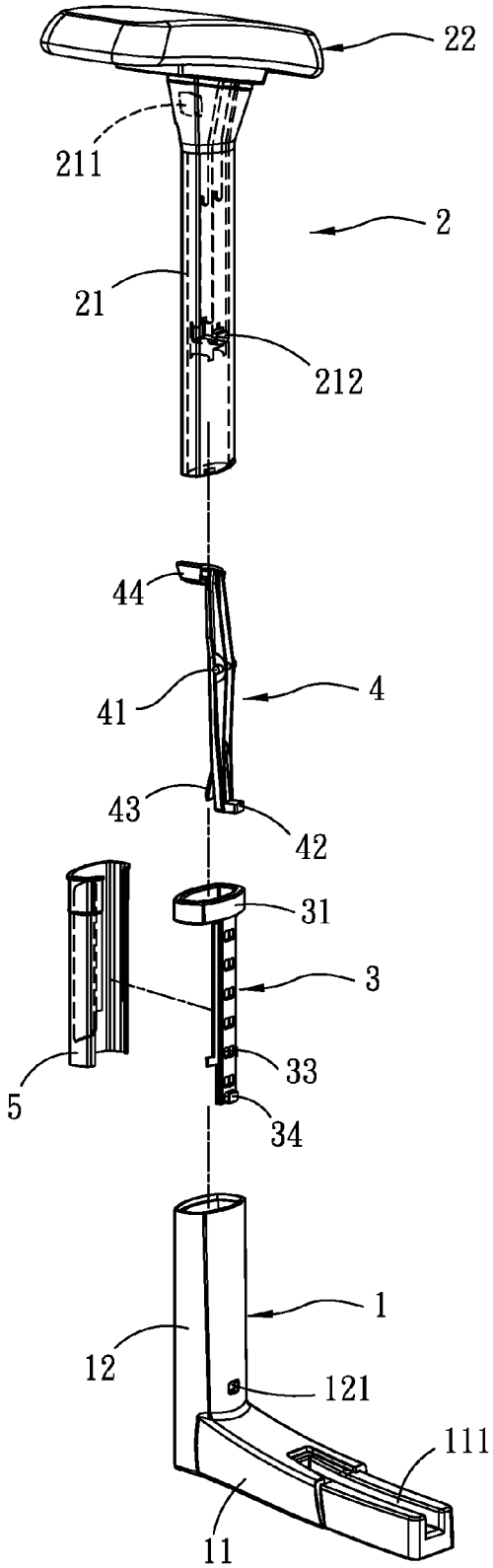
FIG. 3 is an exploded view of the invention.

Please refer to FIGS. 1-3. As shown in FIG. 1, the armrest assembly of the invention is installed to two sides of a chair 100. As shown in FIGS. 2 and 3, the armrest assembly is primarily composed of a connecting seat 1 and an armrest seat 2. The connecting seat 1 is fastened to the bottom of the cushion 101 of the chair 100. The connecting seat 1 is of an L shape and is composed of a connecting rod 11 and a connecting tube 12. In this embodiment, the connecting rod 11 and the connecting tube 12 are integratedly formed. The connecting seat 11 is formed with a connecting trough 111 for connecting the cushion 101. The connecting tube 12 has a fixing hole 121 near the bottom end thereof.

Please refer to FIG. 3. An adjusting rod 3 is received in the connecting tube 12. The adjusting rod 3 is provided with a ring 31 and a bar 32 thereunder. The bar 32 is received in the connecting tube 12 and the ring 31 abuts against an opening of the connecting tube 32. The bar 32 is formed with adjusting holes 33 in a row and a fixing block 34 near the bottom end of the bar 32. The adjusting block 34 is received in the fixing hole 121 for securing the adjusting rod 3 and the connecting tube 12. A link 4 is further received in the connecting tube 12 and parallel to the adjusting rod 3. A middle portion of the link 4 is formed with a protrusion 41. A bottom end of the link 4 is formed with a fixing insert 42 toward the adjusting rod 3. The fixing insert 42 is embedded into one of the adjusting holes 33. A flexible arm 43 is arranged near the fixing insert 42 and is opposite to the fixing insert 42. A top end of the link 4 is provided with a pushing button 44 toward an opposite direction of the fixing insert 42.

The armrest seat 2 has a support 21 and an armrest 22 atop the support 21. The armrest seat 2 is of a T shape. The support 21 is hollow and partially received in the connecting tube 12 with engaging the support 21 with the ring 31 so that the armrest seat 2 and the connecting seat 1 can be secured. The link 4 is also received in the connecting tube 12 and the support 21. The protrusion 41 presses against the support 21. The pushing button 44 projects from a through hole 211 of the support 21. The support 21 is formed with a receiving hole 212 for receiving the fixing insert 42. The connecting tube 12 is further provided with a sheath 5 for securing the connecting seat 1 and the armrest seat 2.

Figure 4:
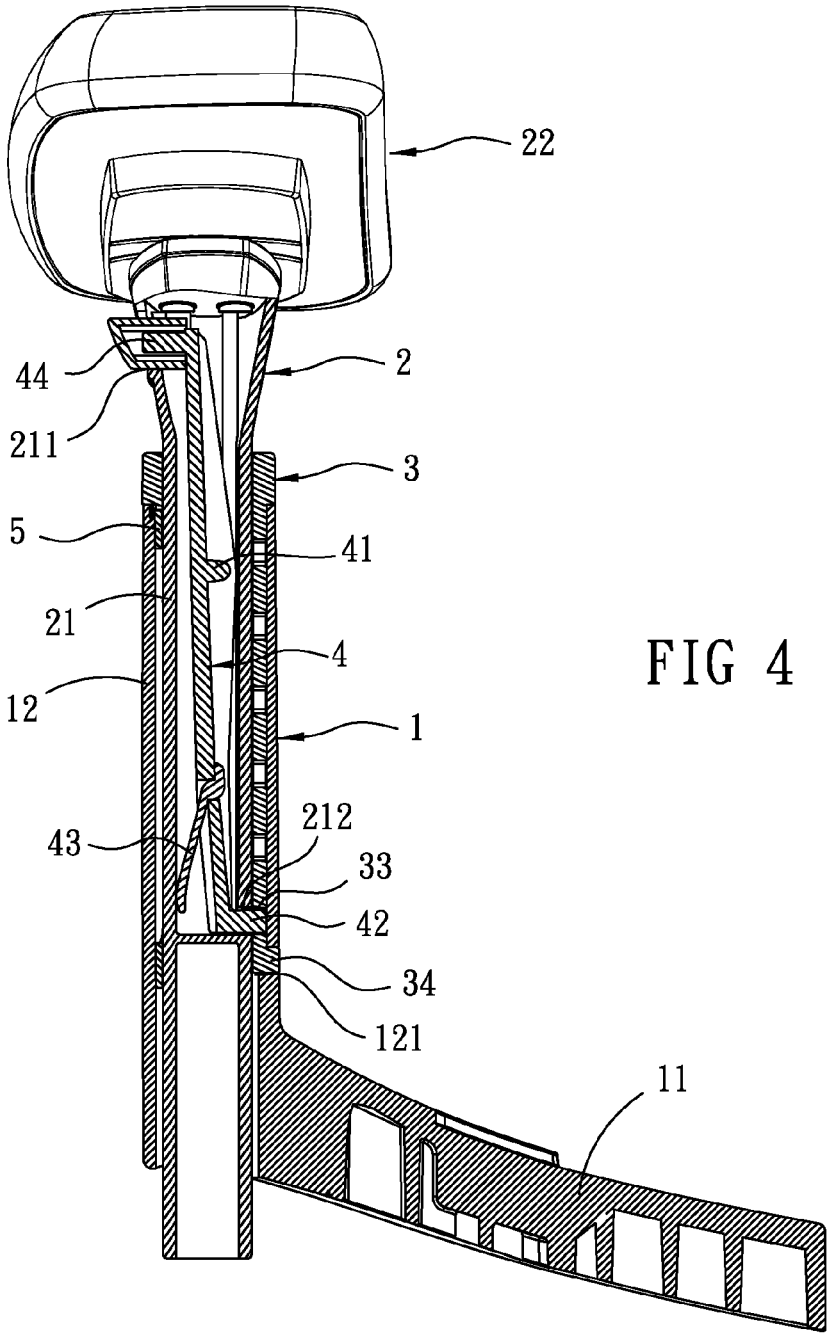
FIGS. 4-6 are cross-sectional views of the invention in different statuses.
Figure 5:
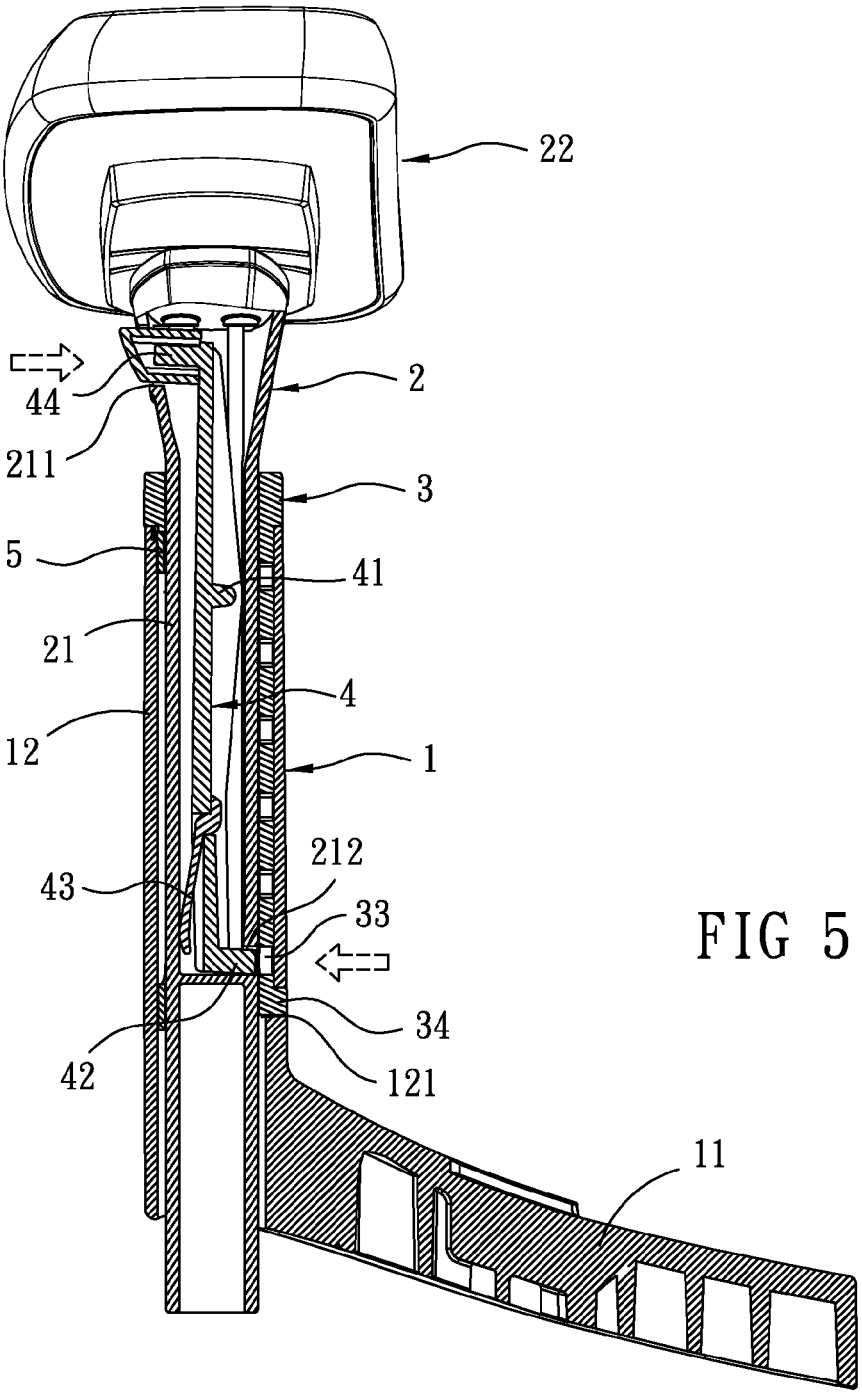
Figure 6:
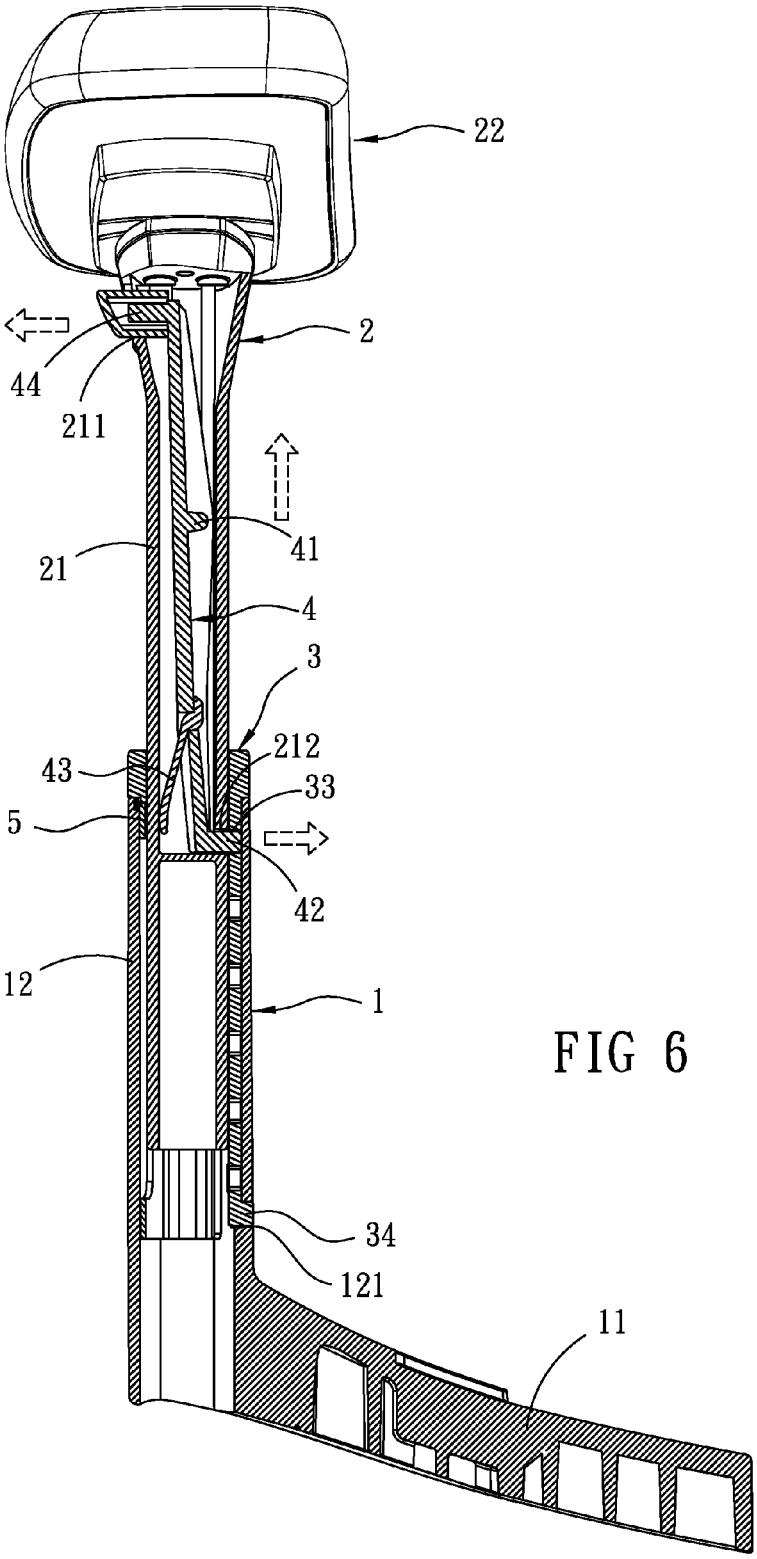

Please refer to FIGS. 4-6. As shown in FIG. 4, in an initial status, the fixing insert 42 is embedded into the receiving hole 212 and the bottom one of the adjusting holes 33. To adjust height of the armrest 22, as shown by the arrow in FIG. 5, the link 4 likes a seesaw with a fulcrum formed by the protrusion 41, pressing the pushing button 44 will make the fixing insert 42 escape the receiving hole 212 and the adjusting hole 33 so that the support 21 can be moved in the connecting tube 12. As shown in FIG. 6, when the support 21 is pulled up to a desired position, the receiving hole 212 just corresponds to another adjusting hole 33, the link 4 is pushed by the flexible arm 43 to embed the fixing insert 42 into the receiving hole 212 and adjusting hole 33 and the pushing button 44 returns.

Figure 7:
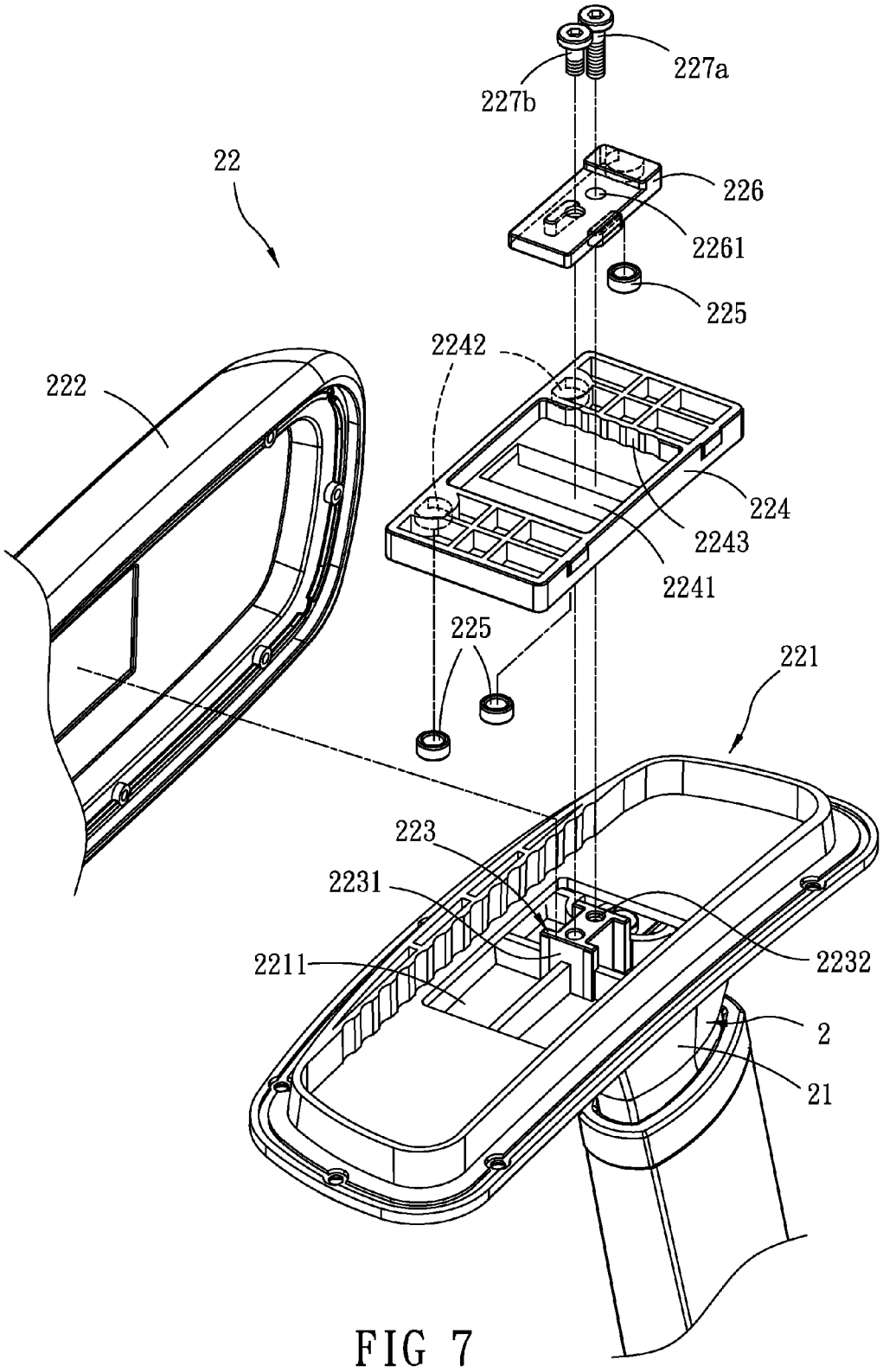
FIG. 7 is an exploded view of the armrest of the invention.
Figure 8:
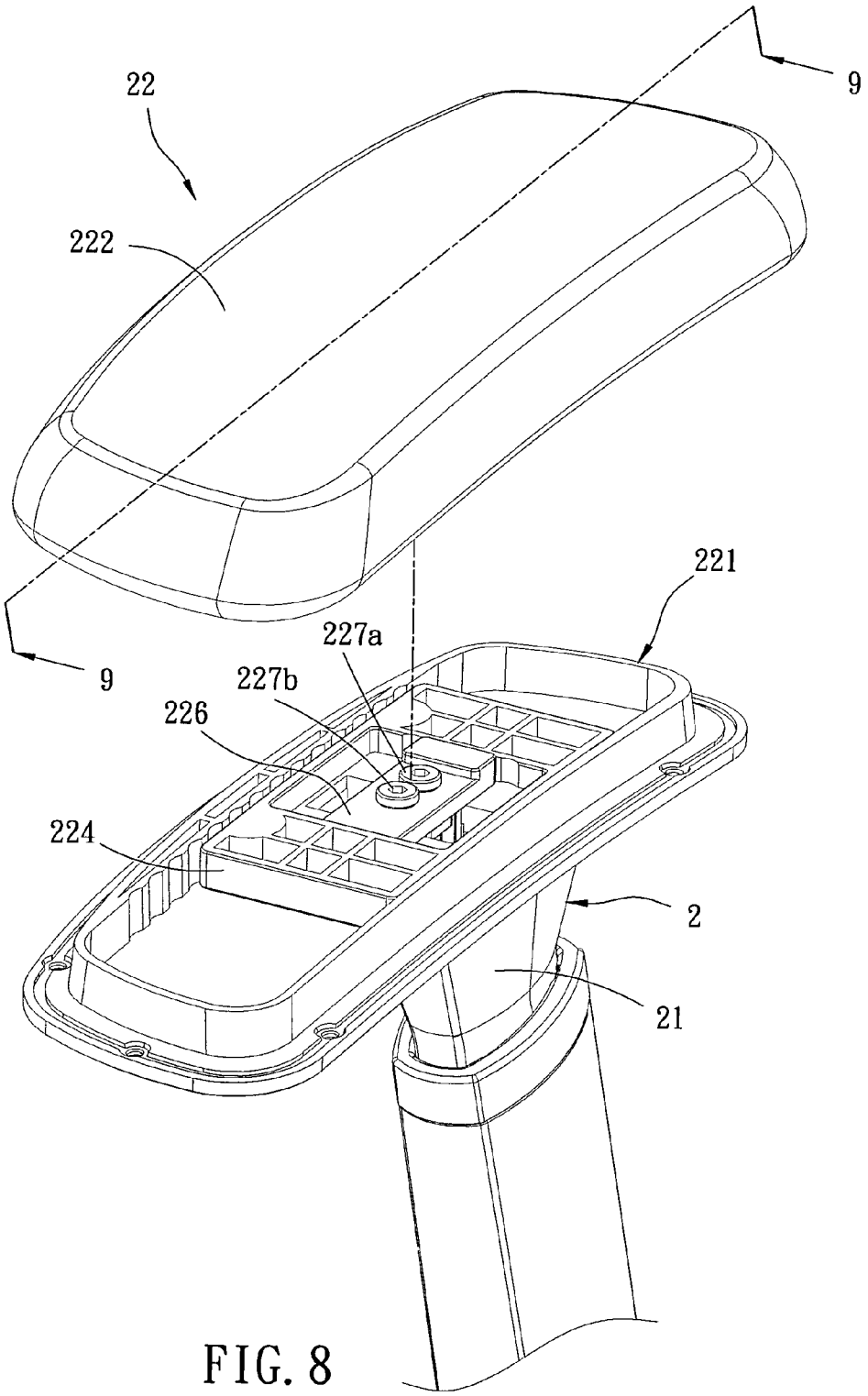
FIG. 8 is an assembled view of the armrest of the invention.

Please refer to FIG. 7. The armrest 22 is composed of a base 221 and a cover 222. The base 221 is formed with a connecting cavity 2211 and a connecting member 223 therein. The connecting member 223 has a column 2231 with threaded holes 2232. Additionally, the base 221 has a fixing plate 224 over the connecting member 223. The fixing plate 224 has a sliding trough 2241 around the column 2231. A side of the fixing plate 224 is provided with round holes 2242 and flexible washers 225 separately received in the round holes 2242. A fixing member 226 is placed in the fixing plate 224. The fixing member 226 corresponds to the column 2231. The fixing member 226 has screw holes 2261 corresponding to the threaded holes 2232 for being passed by bolts 227. One of the bolts **227*a* is screwed into the screw hole 2261 and the threaded hole 2232 to secure the connecting member 223 and the fixing member 226. Another bolt 227*b* is screwed into the screw hole 2261 only. As shown in FIG. 8, the fixing member 226 is provided with a flexible washer 225 corresponding to a waved surface 2243 of the fixing plate 224**.

Figure 9:
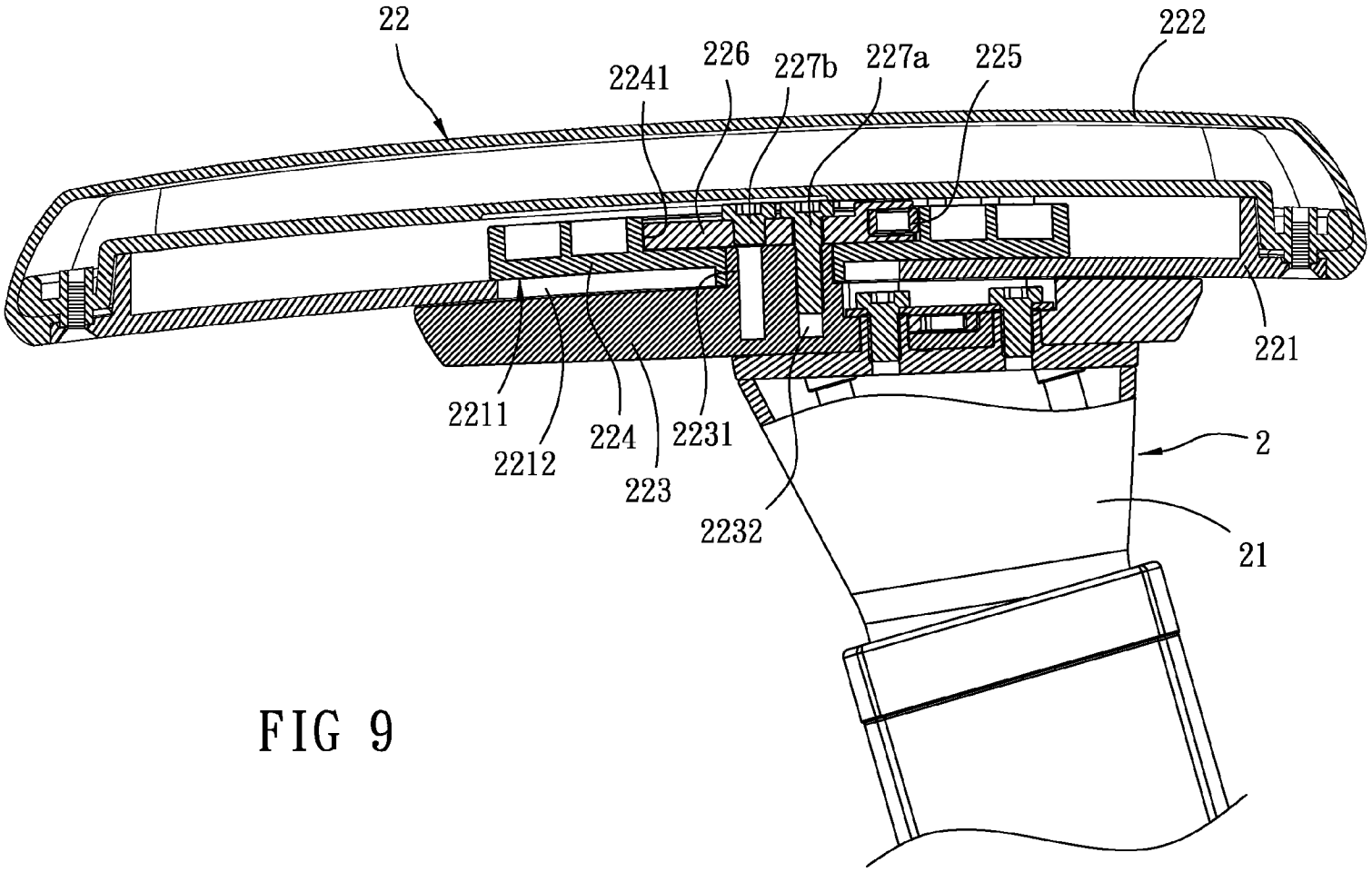
FIGS. 9-10 are longitudinally sectional views of the armrest of the invention.
Figure 10:
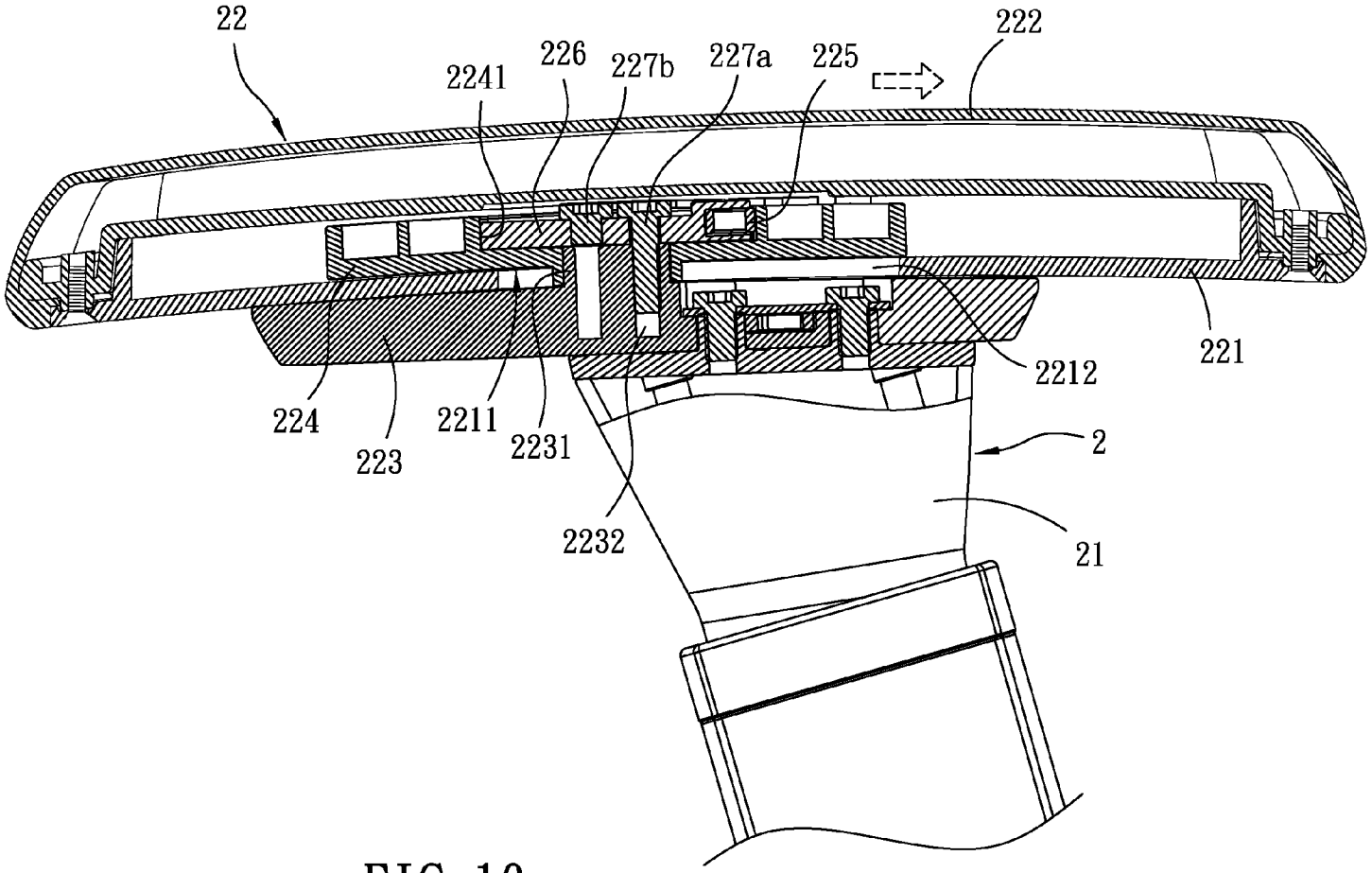

Please refer to FIGS. 9 and 10. The armrest 22 is connected to the support 21 through the connecting member 223. When the connecting member 223 is located in connecting cavity 2211, a gap 2212 is formed between the connecting cavity

2211 and the connecting member 223 so that the bottom of the base 221 can be embedded into the gap 2212. As a result, the base 221 may be longitudinally adjusted as shown in FIG. 10.

Figure 11:
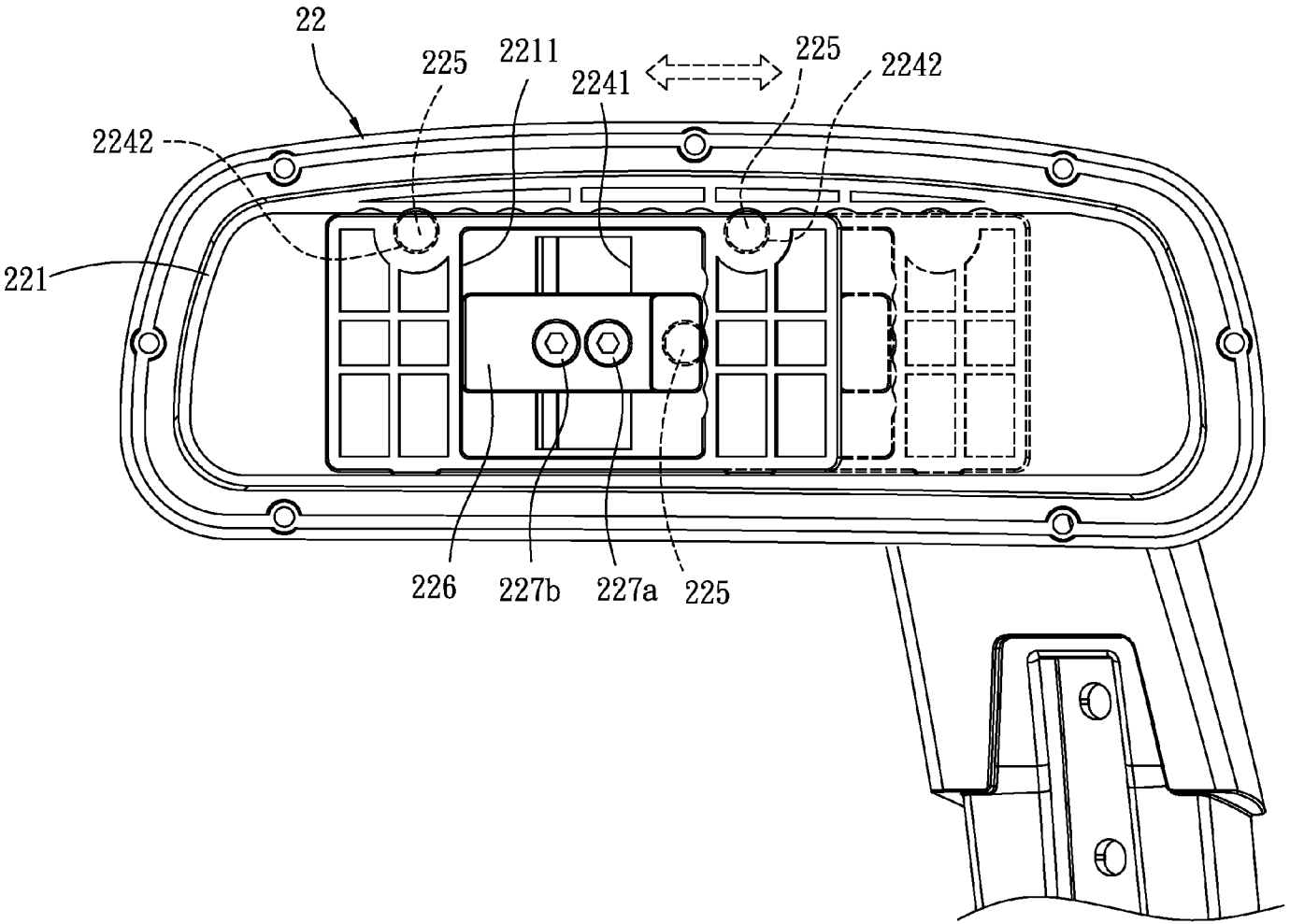
FIGS. 11-13 are schematic view shows how the armrest is adjusted.
Figure 12:
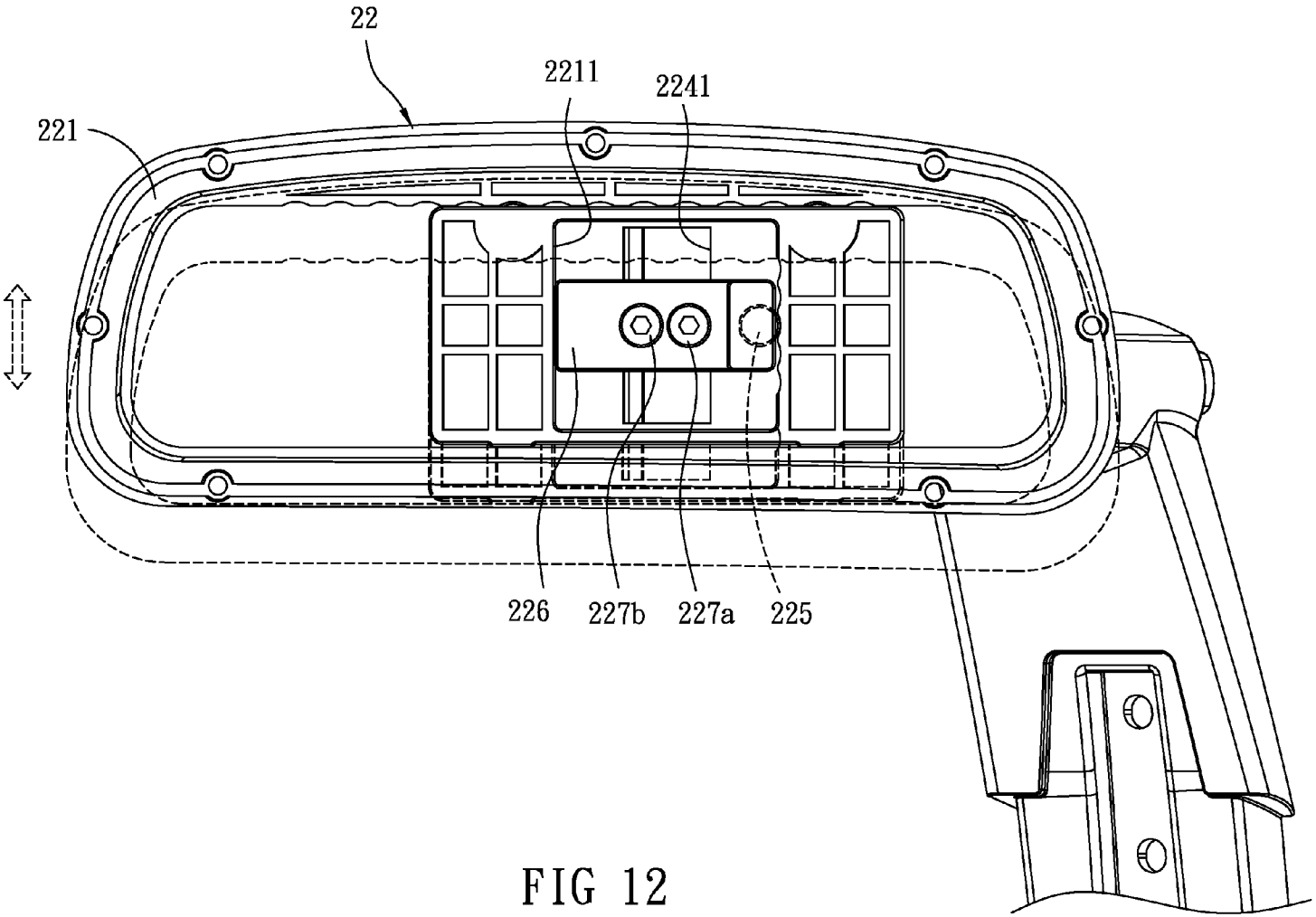

Please refer to FIGS. 11 and 12. The base 221 may be horizontally adjusted by attaching the flexible washer 225 in the fixing member 226 onto the waved surface 2243.

Figure 13:
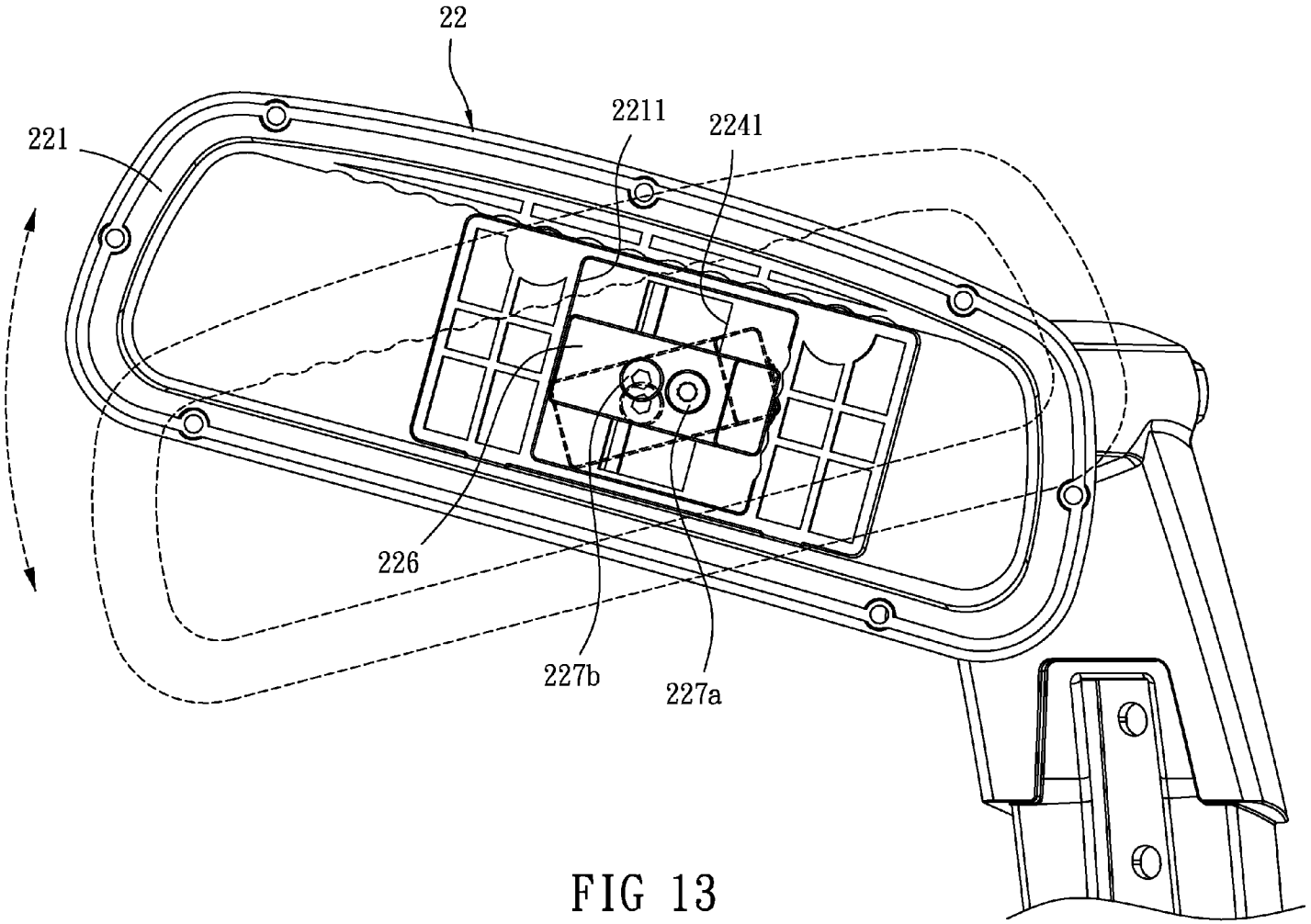

Please refer to FIG. 13. The fixing member 226 may rotate about the bolt 227*a* screwed in the screw hole 2261 and the threaded hole 2232 within a range of 30 degrees. As a result, the armrest 22 is rotatable.

What is claimed is:

1. A chair armrest assembly comprising:

a connecting seat, comprising a connecting rod and a hollow connecting tube with a fixing hole at a bottom thereof;

an adjusting rod, having a ring and a bar thereunder, the bar being received in the connecting tube and formed with adjusting holes in a row, a fixing block being formed under the adjusting holes and inserted into the fixing hole;

a link, passing through the connecting tube, being parallel with the adjusting rod, two ends of the link being separately formed with a fixing insert for being inserted into one of the adjusting holes and a pushing button at an opposite side of the fixing insert, and a flexible arm being oppositely formed from the fixing insert; and an armrest seat, comprising a support and an armrest atop the support, the support being received in the connecting tube and receiving the link, the pushing button projecting from a through hole of the support, and the fixing insert being received in a receiving hole of the support.

2. The chair armrest assembly of claim 1, wherein the connecting tube is further provided with a sheath for securing the connecting seat and the armrest seat.

3. The chair armrest assembly of claim 1, wherein the connecting seat is of an L shape.

4. The chair armrest assembly of claim 1, wherein the armrest seat is of a T shape.

5. The chair armrest assembly of claim 1, wherein a middle portion of the link is formed with a protrusion pressing against an inner surface of the support.

6. The chair armrest assembly of claim 1, wherein the armrest further comprises:

a base, being formed with a connecting cavity;

a connecting member, formed in the connecting cavity, and having a column;

a fixing plate, disposed on the base and over the connecting member, having a sliding trough around the column;

a fixing member, corresponds to and fastened to the column; and a cover, fastened to the base.

7. The chair armrest assembly of claim 6, wherein a side of the fixing plate is provided with round holes and flexible washers separately received in the round holes.

8. The chair armrest assembly of claim 6, wherein the column is formed with threaded holes, the fixing member has screw holes corresponding to the threaded holes for being passed by bolts for securing the connecting member and the fixing member.

9. The chair armrest assembly of claim 6, wherein the fixing member is provided with a flexible washer corresponding to a waved surface of the fixing plate.

* * * * *